United States Patent [19]

Piatt

[11] Patent Number: 4,889,510

[45] Date of Patent: Dec. 26, 1989

[54] HARNESS FOR SWIM FINS

[76] Inventor: John A. Piatt, 226 Getchell St., Santa Cruz, Calif. 95060

[21] Appl. No.: 202,109

[22] Filed: Jun. 3, 1988

[51] Int. Cl.[4] ..... A63B 31/14

[52] U.S. Cl. ..... 441/63; 441/61

[58] Field of Search ..... 441/55, 75, 61-65; 36/115, 8.1, 113, 116

[56] References Cited

U.S. PATENT DOCUMENTS

| | | | |
|---|---|---|---|
| 1,007,867 | 11/1911 | Halvorsen | 441/62 |
| 1,452,790 | 4/1923 | Claupin | 441/62 |
| 1,878,916 | 9/1932 | Trujillo | 441/63 |
| 1,906,682 | 5/1933 | Weimer | 441/63 |
| 2,172,938 | 9/1939 | Kahn | 441/63 |
| 3,557,397 | 1/1971 | Margolies | 441/61 |
| 3,952,351 | 4/1976 | Gisbert | 441/64 |
| 4,599,071 | 7/1986 | Juang | 441/63 |

*Primary Examiner*—Joseph F. Peters, Jr.
*Assistant Examiner*—Clifford T. Bartz
*Attorney, Agent, or Firm*—Robert C. Hill

[57] ABSTRACT

Harness for securing a swim fin beneath a wearer's foot is disclosed including two strap portions having respective front and rear anchor points on opposite sides of the fin relative to the wearer's foot, the strap portions forming an X configuration and being sufficiently long to pass over the wearer's instep, an adjustable heel strap being secured to the respective strap portions forward of their rear anchor points and of a sufficient length for adjustable engagement behind and above the wearer's heel.

4 Claims, 1 Drawing Sheet

FIG. 1
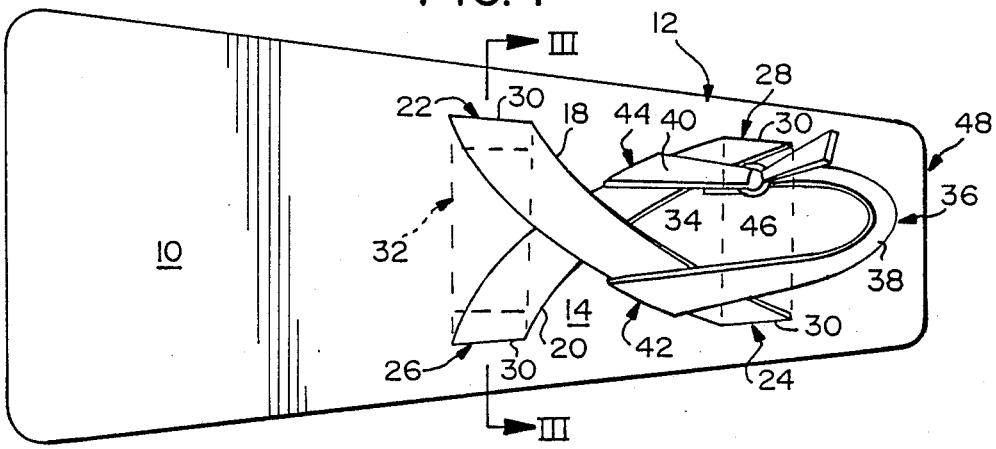
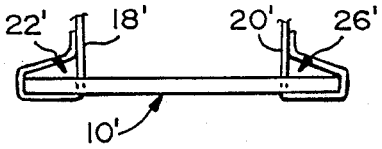
FIG. 3A
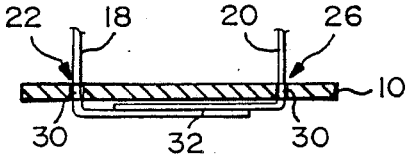
FIG. 3
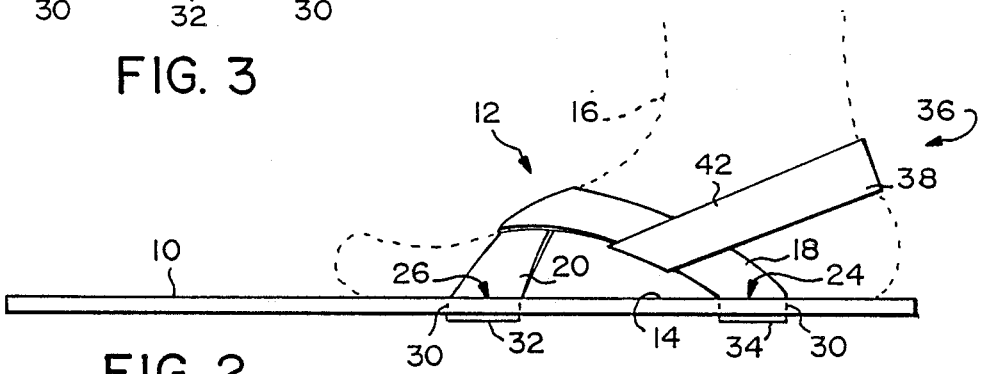
FIG. 2

HARNESS FOR SWIM FINS

FIELD OF THE INVENTION

The present invention relates to harness for securing swim fins beneath a wearer's foot.

BACKGROUND OF THE INVENTION

Two types of harness for securing swim fins have been provided in the prior art. For example, swim fins are often formed with compartments enclosing the entire foot or only the toes and instep of the wearer's foot with a sliding adjustment being provided around the heel to accommodate feet of different size. Such configurations are relatively expensive and do not provide the comfort or flexibility for varying foot sizes.

Harness for strap configurations have not been made available in designs for swim fins but have been used for footwear such as sandals.

A typical footwear strap configuration of the type referred to immediately above was disclosed, for example, in U.S. Pat. No. 4,584,782 issued Apr. 29, 1986 to Thatcher. The strap arrangement of that patent is illustrative of the relatively complex configuration available in the prior art to provide for adjustment to the wearer's foot.

Accordingly, there has been found to remain a need for a harness or strap configuration of relatively simple design while providing adjustment to adapt the harness to varying foot sizes and also to provide a simple means for more securely fastening swim fins to a wearer's foot.

SUMMARY OF THE INVENTION

It is therefore an object of the invention to provide an improved harness for securing a swim fin to a wearer's foot, the harness including two strap portions each having respective front and rear anchor points on opposite sides of the fin to the wearer's foot, the strap portions passing in an X configuration over the wearer's instep, and an adjustable heel strap being secured to the respective strap portions forward of their rear anchor points, the adjustable heel strap being of a suitable length for adjustable engagement behind and above the wearer's heel.

Within the above design, the two strap portions may either be secured to the swim fin at the respective anchor points or the two strap portions may be formed from a single strap passing through slots in the swim fin at the respective anchor points.

It is the related object of the invention to provide a harness for securing swim fins beneath a wearer's foot wherein a strap assembly is anchored to a forward portion of the platform and has two diverging strap portions extending rearwardly to rear anchor points on opposite sides of the swim fin, a similar adjustable heel strap being connected with the two strap portions in the same manner described above.

Additional objects and advantages of the invention are made apparent in the following description having reference to the accompanying drawings.

BRIEF DESCRIPTION OF THE DRAWINGS

FIG. 1 is a top view of a swim fin with harness constructed according to the present invention for securing the swim fin to a wearer's foot.

FIG. 2 is a side view of the swim fin and harness of FIG. 1 with the wearer's foot being illustrated in phantom to better demonstrate the purpose and configuration of the harness.

FIG. 3 is a view taken along section line III—III of FIG. 1.

FIG. 3A is a view similar to FIG. 3 but illustrating another embodiment of the invention.

DESCRIPTION OF THE PREFERRED EMBODIMENT

Harness for securing a swim fin to a wearer's foot is illustrated in the figures, the swim fin being generally indicated at 10 and the harness being generally indicated at 12. Referring particularly to FIG. 2, a rearward portion 14 of the swim fin 10 is adapted or configured to fit beneath the wearer's foot. That portion 14 could be configured, for example, by means of indentations or the like (not shown) in order to better adapt the swim fin to the wearer's foot.

In any event, the harness 12 is preferably positioned upon the swim fin 10 in order to secure the wearer's foot directly above the rearward portion 14. Referring again particularly to FIG. 2, the wearer's foot is indicated in phantom at 16 with the wearer's foot being positioned upon the rearward portion 14 of the swim fin by the harness 12.

Referring to FIGS. 1–3 in combination, the harness 12 comprises first and second strap portions 18 and 20, each having front and rear anchor points on opposite sides of the swim fin 10. The front and rear anchor points for the first strap 18 are indicated respectively at 22 and 24 while the front and rear anchor points for the second strap portion 20 are indicated respectively at 26 and 28.

The two strap portions 18 and 20 thus from an X configuration with the first strap portion 18 passing over the second strap portion 20. Referring also to FIG. 2, the first and second strap portions 18 and 20 are formed with a sufficient length to pass generally over the wearer's instep and thus secure a forward portion of the wearer's foot 16 to the swim fin 10.

Referring in combination to FIG. 1 and FIG. 3, the first and second strap portions 18 and 20 are formed by a single strap (18–20) passing through slots 30 formed at each of the anchor points 22, 24, 26 and 28 in the swim fin 10. Thus, portions 32 and 34 pass beneath the fin to interconnect the two strap portions 18 and 20. Referring particularly to FIG. 3, end portions of the single strap are arranged beneath the fin 10 in overlapping relation and secured to each other along their overlapping lengths to facilitate construction of the harness of FIGS. 1–3.

An alternate embodiment is illustrated in FIG. 3A where the respective end of the two strap portions indicated respectively at 18' and 20' secured directly to the anchor points on the swim fin. In FIG. 3A, the swim fin is indicated at 10' and the front anchor points for the strap portions 18 and 20 are indicated respectively at 22' and 26'.

An adjustable heel strap for the harness 12 of the present invention is generally indicated at 36 in FIGS. 1 and 2. The adjustable heel strap 36 is formed by first and second heel strap elements 38 and 40. The first heel strap element 38 is secured at one end 42 to the first strap portion 18 just forward of its rear anchor point 24. The second heel strap element 40 is similarly secured at 44 to the second strap portion 20 just forward of its rear anchor point 28. The second heel strap element 40 has a clasp or other fastening means 46 secured to its opposite end with an adjustable fastener 48 being secured to or formed as an opposite end portion of the first heel strap element 38. For example, the adjustable fastener 48 could be formed with Velcro type fastening surfaces so that it could be passed through the clasp 46 and adjustably secured to itself. Other adjustable fastener configurations could of course also be employed within the scope of the invention.

In any event, the harness 12 of the present invention is of particularly simple construction for use on swim fins. A wearer may simply insert the instep of his foot beneath the first and second strap portions 18 and 20 and then adjustably secure the heel strap assembly 36 above and behind the heel in order to comfortably secure the swim fin 10 to his foot.

It is of course contemplated that mirror image configurations could be formed in both the swim fin 10 and the harness 12 to better adapt to the wearer's left and right feet. Similarly, both the first and second strap portions 18 and 20 as well as the adjustable heel strap assembly 36 are preferably formed from flexible material in order to better conform to the configuration of the wearer's foot and to comfortably secure the footwear in place.

There have been described above two embodiments of harness suitable for securing swim fins or other footwear on a wearer's foot. Other variations will be apparent in addition to those specifically described above. Accordingly, the scope of the present invention is defined only by the following appended claims.

What is claimed is:

1. Harness for securing a swim fin beneath a wearer's foot, comprising a single strap having two strap portions each having respective front and rear anchor points on opposite sides of the fin relative to the wearer's foot, the strap portions being arranged in an X configuration relative to each other and being of a suitable length for passing over the wearer's instep, said single strap having opposite end portions passing downwardly through the respective front anchor point and being overlapped and secured to each other beneath the fin to assure a positive coupling therebetween, and an adjustable heel strap secured to the respective strap portions forward of their rear anchor points, the adjustable heel strap being of a suitable length for adjustable engagement behind and above the wearer's heel.

2. The swim fin harness of claim 1 wherein front and rear ends of the two strap portions are secured to the respective front and rear anchor points of the swim fin.

3. The swim fin harness of claim 1 wherein the heel strap comprises a first heel strap element secured to one strap portion and a second heel strap element secured at one end to the other strap portion, adjustable means being secured to the opposite end of the second heel strap element for adjustable engagement with the first heel strap element.

4. The swim fin harness of claim 1 wherein the two strap portions and the adjustable heel strap are flexible to adapt to the configuration of the wearer's foot and to comfortably secure the swim fin in place.

* * * * *